US007044669B2

(12) United States Patent
Winckels et al.

(10) Patent No.: US 7,044,669 B2
(45) Date of Patent: May 16, 2006

(54) PACKAGING DEVICE FOR A FLUID PRODUCT

(75) Inventors: Mathilde Winckels, Clichy (FR); Guilhem Rousselet, Saint Maur des Fosses (FR)

(73) Assignee: L'Oreal, Paris (FR)

( * ) Notice: Subject to any disclaimer, the term of this patent is extended or adjusted under 35 U.S.C. 154(b) by 171 days.

(21) Appl. No.: 10/726,481

(22) Filed: Dec. 4, 2003

(65) Prior Publication Data

US 2004/0159579 A1 Aug. 19, 2004

Related U.S. Application Data

(60) Provisional application No. 60/441,486, filed on Jan. 22, 2003.

(30) Foreign Application Priority Data

Dec. 4, 2002 (FR) ..... 02 15286

(51) Int. Cl.
*A46B 11/00* (2006.01)

(52) U.S. Cl. ..... 401/122

(58) Field of Classification Search ..... 401/121, 401/122, 126–130, 118; 215/355, 356, 357
See application file for complete search history.

(56) References Cited

U.S. PATENT DOCUMENTS

| | | | | | |
|---|---|---|---|---|---|
| 752,591 | A | * | 2/1904 | Robinson | 401/121 |
| 2,627,619 | A | * | 2/1953 | Gagen | 15/257.05 |
| 3,280,421 | A | * | 10/1966 | Davidson | 401/122 |
| 3,558,022 | A | * | 1/1971 | Zytko | 222/490 |
| 4,433,928 | A | * | 2/1984 | Kingsford | 401/122 |
| 4,628,950 | A | * | 12/1986 | Bitzer | 132/218 |
| 5,190,389 | A | | 3/1993 | Vasas | |
| 5,284,239 | A | | 2/1994 | Kiricoples | |
| 5,826,741 | A | * | 10/1998 | Dumler et al. | 215/321 |
| 5,961,238 | A | | 10/1999 | de Bruin et al. | |
| 6,149,334 | A | | 11/2000 | Nicoll | |

FOREIGN PATENT DOCUMENTS

GB 683932 12/1952

* cited by examiner

*Primary Examiner*—Justine R. Yu
*Assistant Examiner*—Huyen Le
(74) *Attorney, Agent, or Firm*—Oblon, Spivak, McClelland, Maier & Neustadt, P.C.

(57) ABSTRACT

A packaging device for a fluid product which includes a bottle formed by a body and a neck with an axis X. The opening of the neck is defined by a rim which includes an inner portion and an outer portion. In the illustrated embodiment, at least part of the outer portion is located axially above the inner portion. A flow reducer is mounted in the neck opening, with the reducer incorporating a flange resting on the inner portion of the rim of the neck. The flow reducer is also spaced from at least part of an outer portion of the rim of the neck.

46 Claims, 2 Drawing Sheets

PACKAGING DEVICE FOR A FLUID PRODUCT

CROSS-REFERENCE TO RELATED APPLICATIONS

This document claims priority to French Application Number 02 15286, filed Dec. 4, 2002, and U.S. Provisional Application No. 60/441,486, filed Jan. 22, 2003, the entire contents of which are hereby incorporated by reference.

BACKGROUND OF THE INVENTION

1. Field of the Invention

The invention relates to a packaging device for a fluid product. The invention can be particularly advantageous for a liquid or viscous product such as may be found in the fields of cosmetics, paints or adhesives. More particularly, the invention can be advantageous in the field of cosmetics, with the product, for example, a nail varnish or nail polish composition or other nail care product.

2. Discussion of Background

Generally, a nail varnish or polish applicator set includes a reservoir for the product to be applied and a product applicator, such as a brush with a tuft of bristles attached to a first extremity of a rod. The rod is fixed at its other extremity in a cap intended to close the reservoir so that the tuft of bristles is immersed in the product when the applicator set is closed.

To ensure efficient closure of the unit, the reservoir includes a neck incorporating a first screw thread which engages with a second screw thread provided in the cap. The cap includes a transverse wall which is in contact with the upper edge of the neck when the applicator set is closed. The screw thread is formed over the full height of the neck and is flush with the upper extremity of the neck.

In this type of packaging, the neck opening is sufficiently large such that when the reservoir is in the open position the product is able to flow out of the reservoir if the reservoir is overturned.

Furthermore, to apply the product to the nail, the applicator impregnated with product is withdrawn from the reservoir. Generally, the brush carries an excess amount of product. It is therefore necessary to remove this excess product, and in order to do this the user strips the brush by wiping it on the end of the reservoir neck. The product may then remain on the neck and run along the external wall of the neck, thereby fouling the screw thread on the neck. When the cap is screwed back on to close the reservoir, the product is then spread over the neck and into the screw thread. The product then dries, thus forming a build-up on the cap/neck assembly. During subsequent use it becomes difficult, or even impossible, to unscrew the cap from the reservoir. Moreover, the product present on the neck prevents effective sealing of the applicator unit because the cap is no longer in leaktight contact with the upper edge of the neck.

To avoid having to wipe the brush on the rim of the neck, it is possible for example to use a stripper element mounted inside the neck as described in document GB 683,932. In this document, the stripper element is composed of a tubular element terminating in a tapered portion which converges towards flexible lips. The flexible lips define an opening having a diameter less than or equal to that of the stem of the brush. When the cap is opened, the brush is stripped by the stripping lips and the user no longer needs to wipe the brush on the rim of the neck. In this device, the stripper element includes a flange which bears against the upper extremity of the neck. This is also the case with the stripper element described in U.S. Pat. No. 5,284,239.

U.S. Pat. No. 5,961,238 also describes a stripper element mounted inside the neck of a reservoir. The stripper element incorporates a flange bearing not on the upper extremity of the neck but in an indentation provided inside the neck. However, the flange of the stripper element projects slightly beyond the upper extremity of the neck.

In the devices described in these two documents, the cap bears in a leaktight manner on the flange of the stripper element. When the brush is withdrawn from the reservoir, product can be deposited around the neck opening, and therefore onto the flange of the stripper element, so that when the cap is reclosed the product can cause the stripper element to stick to the cap as it dries. At the next opening, the stripper element can tend to remain stuck to the cap and to come out of the neck or at least be displaced inside the latter.

SUMMARY OF THE INVENTION

It is an object of the invention to provide a packaging device for a fluid product which does not present the drawbacks of the prior art.

It is another object of the invention to provide a packaging device which reduces the risk of the product running out of the reservoir, particularly when the device is accidentally overturned.

A further object of the invention is to provide a packaging device which makes it possible to limit and/or regulate the quantity of product on the applicator while at the same time avoiding fouling of the reservoir neck.

It is also an object of the invention to provide a packaging device which makes it possible to reduce evaporation of the product contained in the reservoir.

A still further object of the invention is to provide a packaging device which includes a reducer securely retained inside the device.

It is yet another object of the invention to provide a packaging device which incorporates a reducer that does not deteriorate over time.

According to the invention, these objects can be achieved by a packaging device for a fluid product which includes a bottle formed by a body surmounted by a neck with an axis X having an opening. In the illustrated preferred embodiment, the opening is defined by a rim which includes an inner portion and an outer portion, with at least part of the outer portion located axially above the inner portion. A flow reducer is mounted in the neck opening. The reducer has a flange bearing on the inner portion of the rim of the neck. The flange of the reducer extends to a non-zero axial distance from at least a part of the outer portion of the rim and is located axially between the inner and outer portions of the neck rim. By having the flange of the reducer spaced a non-zero distance from at least part of the outer portion of the rim, the cap can contact the outer portion of the rim without having to contact the flange to thereby reduce the possibility of the reducer becoming coupled to the rim and displaced or loosened upon removal of the cap. The flange can overlie at least part of the inner portion of the rim and can be positioned such that it does not contact the cap when the cap is mounted on the container.

When a bottle of this kind is closed in a leaktight manner by a cap, the cap bears in a leaktight manner on the outer portion of the rim without coming into contact with the reducer which is set back. Thus, even if the product runs onto the flange of the reducer, the clearance between the flange of the reducer and the cap is sufficient to prevent these two components from sticking together, and therefore to prevent the reducer from being pulled out of the neck when the cap is removed. Retention of the reducer in the neck is thus improved. In addition, when the cap is closed, because the sealing action is obtained by engagement of the cap with a portion of the bottle neck and not with the reducer, the bottle is configured so as to be capable of use both with and without a reducer. Also, as the cap is not in contact with the reducer, the latter is not subjected to axial stresses from the cap, reducing the possibility of stress cracking.

The reducer restricts the opening of the bottle, thereby also reducing the risk of accidental spillage or at least reducing the amount of spillage if the bottle is in a non-upright position such as when the bottle is overturned or turned on its side. Evaporation of the product is also reduced, so that the product dries less rapidly inside the bottle when the bottle is open. In addition, the presence of the reducer has the effect of stripping part of the product from the applicator when it is withdrawn from the bottle. This dispenses in particular with the need for the user to wipe the applicator on the neck of the bottle, while leaving sufficient product on the applicator, to cover at least one nail for example.

The reducer can include a free end which, with the reducer mounted in the bottle, is located at a non-zero distance, measured transversely relative to the axis X, from the walls of the bottle. A space is thus created between the bottle and the reducer which prevents the product from running into the passage defined by the reducer. In a disclosed example, the product can remain in the annular space or volume formed around the reducer. The risk of accidental spillage of product from the bottle is thus further reduced.

In accordance with a disclosed preferred example, the transverse cross-section of the outer wall of the reducer can be circular and diminish towards its free end so as to form a tapered portion. A shape of this kind facilitates insertion of the reducer into the neck of the bottle.

The reducer can be retained by a force fit inside the neck of the bottle. In accordance with one example, ribs on the outer surface of the reducer are provided in order to compensate for any surface irregularities on the inner wall of the bottle, particularly when the latter is made of glass.

The reducer can be made by molding a thermoplastic material from a single piece. The material can be chosen, for example, from among the polyvinyl chlorides, polypropylenes, polyethylenes, polystyrenes, or a composite of materials of the polypropylene/ethylene-vinyl-alcohol(EVOH)/polypropylene, polyethylene/polyethylene terephthalate, or polystyrene/EVOH/polyethylene type materials.

The device can include a removably mountable cap to close the neck opening in a leaktight manner with respect to the product, such that an inner wall of the cap bears on part of the outer portion of the rim when the cap is mounted in a closed position.

The cap can include a screw thread on its inner wall designed to engage with a counterpart screw thread provided on the outer wall of the bottle neck.

The cap may be integral with an applicator, in particular a brush which can be configured to apply a nail varnish or polish.

The bottle can, for example, be made of glass. The invention is particularly advantageous for use in containers of cosmetic products, and more particularly for nail products such as a nail varnish or polish.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
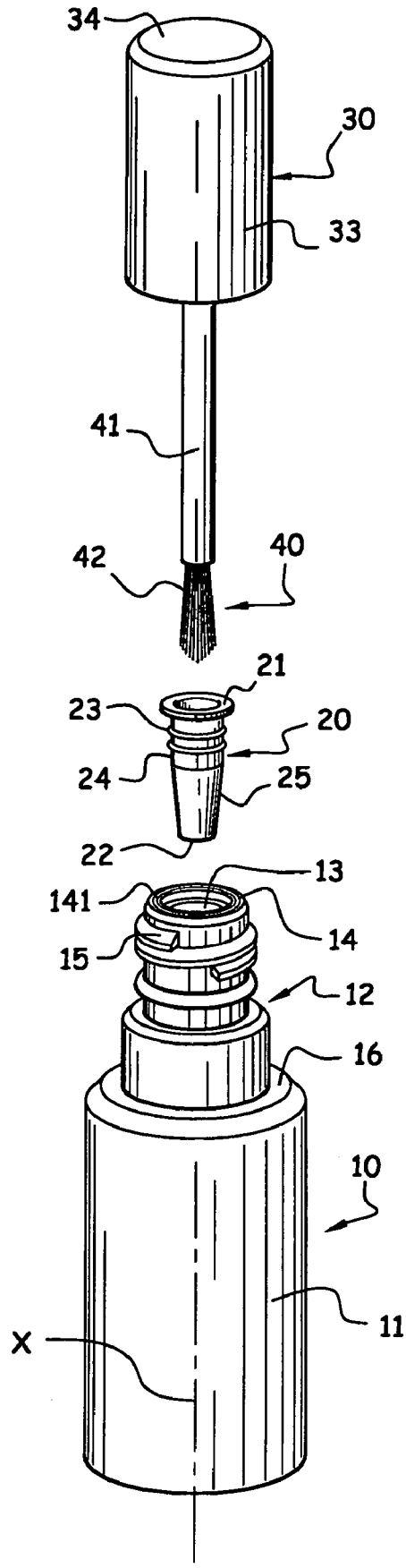
FIG. 1 illustrates an exploded perspective view of an embodiment of a packaging device according to the invention.
Figure 2:
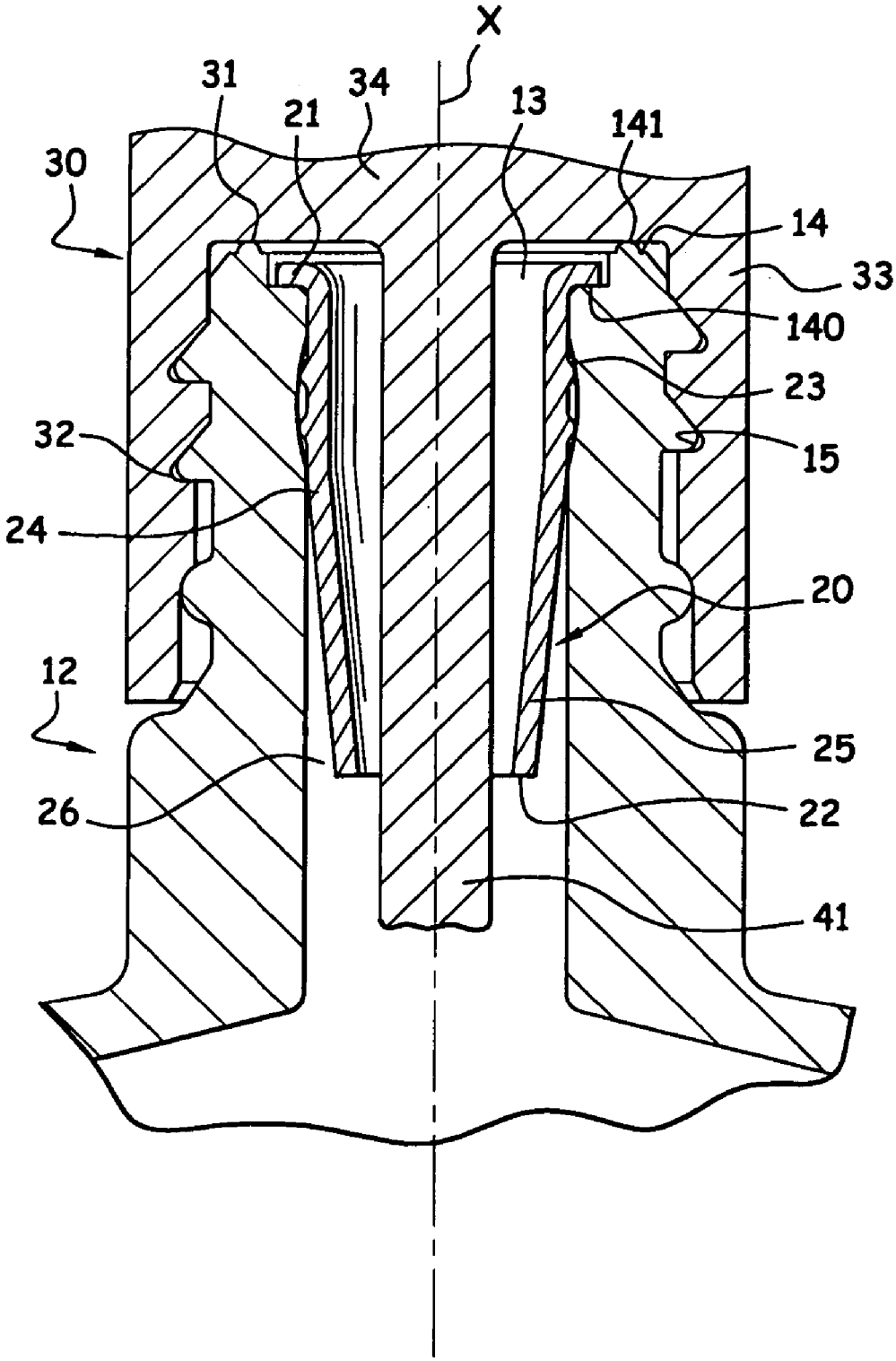
FIG. 2 shows a partial cross-section of the device illustrated in FIG. 1 in the closed position.

The packaging device shown in FIGS. 1 and 2 includes a bottle 10 formed by a body 11 and a neck 12 having a longitudinal axis X, and a cap 30 to close the bottle. The bottle is made of glass, for example. The invention is particularly advantageous for containers that contain, for example, a liquid product. In a particularly preferred form, the container contains a cosmetic product, more preferably a nail care product such as a nail polish or varnish.

According to the example illustrated, the body 11 of the bottle 10 is cylindrical in shape and includes a shoulder 16 having the neck 12 extending thereabove. The neck 12 incorporates a screw thread 15 on its outer wall designed to engage with a counterpart screw thread 32 provided on the inner surface of the closure cap 30. The neck terminates at a rim 14 which defines an opening 13 in the bottle. The neck includes a radial indentation 140 on its inner wall in proximity to its upper extremity which forms an inner annular portion of the rim. Above this indentation, the rim can have an outer annular portion 141 fitted with a seal or seal portion. In the illustrated embodiment, the rim includes a sealing ring on which an inner wall 31 of the cap 30 is intended to bear when the cap is in the closed position. It is to be understood that the outer annular portion 141 need not be fitted with a seal. In the latter case, the cap 30 can bear on the entirety of the outer annular portion 141 of the rim.

The cap 30 includes a skirt 33 closed by a transverse wall 34 integral with an applicator 40. The applicator is, for example, formed by a rod 41 at the end of which is attached a tuft of bristles 42 forming a brush. It is evident that any other applicator can be used in place of the tuft of bristles, including but not limited to a flock tip, a foam tip, a spatula of flexible material, etc.

A flow reducer 20 is mounted in the neck opening. The reducer is made, for example, by molding a thermoplastic material in one piece. Although not to be construed as limiting, preferred examples of materials that can be used for the reducer include polypropylene or polyethylene.

The reducer is formed by a tubular element 24 which terminates at its upper extremity in a flange 21 extending radially outward. The transverse cross-section of the reducer decreases slightly towards a free end 22 opposite to the flange 21, so as to form a tapered portion 25. A shape of this kind facilitates insertion of the reducer into the neck 12. The reducer 20 is held by a force fit inside the neck of the bottle. In the illustrated embodiment, the reducer includes annular ribs 23 on its outer surface enabling it to remain radially constrained by the neck of the bottle at all times, even if there should be some unevenness in the surface of the inner wall of the glass bottle.

The free end 22 of the reducer is located a non-zero distance, measured transversely relative to the axis X, from the walls of the bottle. An annular space 26 or volume is thus created between the bottle and the reducer which prevents the product from running into the passage defined by the reducer. In fact, when the bottle is turned upside down, the product flows by gravity along the inner walls of the bottle and tends to follow these walls so that the product will remain in the annular space formed around the reducer and will not tend to run into the reducer.

The flange 21 of the reducer bears on the inner annular portion 140 of the neck rim. In the arrangement shown, the flange 21 extends a non-zero distance over at least part of the inner portion of the rim. In the preferred embodiment illustrated, the flange is also positioned such that it extends to a non-zero axial distance from at least a part of the outer annular portion 141 of the rim, i.e., the seal. In the preferred example illustrated, the entirety of the top of the flange 21 is located at a non-zero axial distance from the entirety of the outer annular portion 141 of the rim so as to form an axial clearance between the topmost part of the flange 21 and the lowest part of the outer annular portion 141 of the rim. In the illustrated example, this can be achieved by having the inner portion of the rim recessed from the outer portion of the rim by an amount greater than the thickness of the flange of the reducer as shown. In the event that the outer annular portion 141 of the rim does not include a seal and is formed only by a plane annular surface, the entire flange 21 is preferably located at a non-zero axial distance from this plane surface. Thus, the flange can be spaced a non-zero distance (preferably a non-zero axial distance) from at least part of the outer portion of the rim. With this arrangement, it is possible to have the cap contact the outer portion of the rim without contacting the flange when the cap is mounted on the container. The flange can extend to overlie at least a portion of inner portion of the rim and this feature can also allow the cap to contact an outer portion of the rim without contacting the reducer.

The reducer serves in particular to restrict the passage formed inside the neck to prevent the product from running out of the bottle in the event the bottle is turned on its side or turned over. In addition, by selecting its internal diameter as a function of that of the applicator, the reducer can be used to strip the applicator 40 as it is withdrawn from the bottle in order to remove the excess product before use. The quantity of product taken up by the applicator each time it is withdrawn from the bottle is thus regulated.

FIG. 2 illustrates the cap in the closed position, with the cap screwed onto the bottle by the engagement of screw threads 32 and 15, and the brush is seated inside the bottle and immersed in the product. In this closed position, the inner surface 31 of the transverse wall 34 of the cap bears in a leaktight manner on a part of the outer annular portion 141 of the neck rim, e.g., on the sealing ring or seal portion associated with the rim. In this position, there is no contact between the cap and the reducer by virtue of the presence of the axial clearance formed between the flange 21 of the reducer and the outer annular portion 141. There is therefore little risk that any product remaining for example on the flange 21 of the reducer from a previous use will cause the cap to stick to the reducer as it dries. This prevents the reducer from being pulled out when the cap is unscrewed. As shown in FIG. 2, by advantageously positioning the flange of the reducer with respect to the cap and the rim of the bottle, for example, by positioning the reducer flange in a recessed inner portion of the rim as shown, the cap can contact the outer or topmost portion of the rim 141 without the cap contacting the flange of the reducer. In the preferred form, the relationship of the reducer flange and the container rim with respect to the cap are provided by the recess as shown, however, it is to be understood in light of the teachings herein that other positioning expedients could be utilized to accomplish the provision of contact between a top portion of the container rim without contacting the top of the reducer. In addition, although a generally cylindrical container is shown, it is to be understood that other container shapes are possible.

FIG. 2 illustrates that the neck may includes an inner wall and an outer wall. The inner wall includes a curved internal diameter increasing portion such that a diameter of the curved internal diameter increasing portion is larger than diameters of the inner wall above and below the inter diameter increasing portion. Furthermore, the reducer may include a plurality of ribs.

The bottle and cap described above may be used with a reducer, for example, such as that described above, but also without a reducer, in which case the sealing action is effected on the bottle and not on the reducer when the cap is closed. This makes it possible in particular to manufacture bottle-and-cap sets with or without a reducer on the same industrial production line and with the same packaging components.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A packaging device for a fluid product including:

a bottle formed by a body and having a neck with an axis X and an opening, the opening being defined by a rim which includes an inner portion and an outer portion, at least part of the outer portion being axially located above the inner portion, wherein said neck includes an inner wall and an outer wall, the inner wall including a curved internal diameter increasing portion such that a diameter of said curved internal diameter increasing portion is larger than diameters of said inner wall above and below the internal diameter increasing portion;

a cap removably mounted on said bottle, the cap including a hollow portion, an applicator extending within the hollow portion and including an application surface that retains the fluid product for application;

a flow reducer mounted in the opening of the neck, the reducer having a flange resting on the inner portion of the rim of the neck, the flow reducer having a stripper portion for reducing the amount of fluid product from the application surface;

the flange of the reducer extending to a non-zero distance from at least a part of the outer portion of the rim, and further wherein the flange is located axially between said inner and outer portions of the rim of the neck.

2. A device according to claim 1, wherein the reducer includes a free end which, with the reducer mounted in the bottle, is located at a non-zero distance, measured transversely relative to the axis X, from a wall of the bottle.

3. A device according to claim 2, wherein the transverse cross-section of the reducer is circular and diminishes towards its free end so as to form a tapered portion.

4. A device according to claim 1, wherein the reducer is retained by a force fit inside the neck of the bottle.

5. A device according to claim 4, wherein the reducer is mounted only within the neck.

6. A device according to claim 1, wherein the flange of the reducer has an outer diameter smaller than an outer diameter of the inner portion.

7. A device according to claim 1, wherein the reducer is made by molding a thermoplastic material from a single piece.

8. A device according to claim 7, wherein the reducer is made from a thermoplastic material selected from the group consisting of polyvinyl chlorides, polypropylenes, polyethylenes, polystyrenes, and composite of materials of the polypropylene/ethylene-vinyl-alcohol(EVOH)/polypropylene, polyethylene /polyethylene terephthalate, and polystyrene/EVOH/polyethylene type.

9. A device according to claim 1, wherein the cap closes the neck opening in a leaktight manner with respect to the product, wherein an inner wall of the cap bears on at least part of the outer portion of the rim.

10. A device according to claim 9, wherein the cap includes a screw thread on its inner wall designed to engage with a counterpart screw thread provided on an outer wall of the bottle neck.

11. A device according to claim 1, wherein the reducer includes at least one rib located in the curved internal diameter increasing portion of the inner wall.

12. A device according to claim 11, wherein the reducer includes a plurality of ribs located in the curved internal diameter increasing portion.

13. A device as recited in claim 11, wherein said reducer is entirely positioned in said neck, and wherein an outer periphery of said flange of said reducer is radially spaced from an inner periphery of said outer potion of said rim.

14. A device according to claim 1, wherein the applicator is a brush.

15. A device according to claim 1, wherein the bottle is made of glass.

16. A device according to claim 1, wherein the bottle contains a cosmetic product.

17. A device according to claim 1, wherein the bottle contains a nail care product.

18. A device according to claim 1, wherein the bottle contains a nail polish.

19. A device as recited in claim 1, wherein in a mounted position in which said cap is mounted on said bottle, said cap is in contact with said rim of said opening and further wherein in said mounted position said cap does not contact the flange of the reducer.

20. A device according to claim 19, wherein said reducer includes an end disposed within said bottle which is spaced from an inner side surface of said bottle such that a volume is provided between said end of said reducer and said inner side surface such that, when said bottle is moved to a non-upright position, product in said container is held in said volume without passing out of said opening of said neck thereby reducing spillage when said bottle is in the non-upright position.

21. A device according to claim 20, wherein said bottle contains a nail care product.

22. A device according to claim 21, wherein said outer portion of said rim includes a seal portion, and wherein said cap contacts said seal portion to form a seal when said cap is in said mounted position.

23. A device according to claim 1, wherein said outer portion of said rim is spaced from said inner portion by an axial distance larger than a thickness of said flange of said reducer.

24. A packaging device for a fluid product comprising:

a bottle having a body and a neck, said neck having an opening defined by a rim, said rim having an inner portion and an outer portion, wherein said neck includes an inner wall and an outer wall, the inner wall including a curved internal diameter increasing portion such that a diameter of said curved internal diameter increasing portion is larger than diameters of said inner wall above and below said internal diameter increasing portion;

a reducer mounted in the opening of the neck, the reducer including a flange and a plurality of ribs, wherein the flange overlies at least part of said inner portion of said rim, the plurality of ribs being located in the diameter increasing portion of the inner wall; and a cap removably mountable on said neck, wherein in a mounted position said cap is in contact with said outer portion of said rim, and wherein in said mounted position said cap does not contact said reducer.

25. A device as recited in claim 24, wherein a topmost part of said outer portion of said rim is higher than a topmost part of said flange of said reducer.

26. A device as recited in claim 25, wherein said topmost part of said outer portion of said rim forms a seal with said cap when said cap is in said mounted position.

27. A device as recited in claim 26, wherein said topmost part of said outer portion of said rim includes a protruding seal portion and said cap contacts said protruding seal portion when said cap is in said mounted position.

28. A device as recited in claim 26, wherein said inner portion of said rim is recessed with respect to said outer portion of said rim such that said outer portion of said rim is higher than said inner portion of said rim.

29. A device as recited in claim 24, wherein said inner portion of said rim is recessed with respect to said outer portion of said rim such that said outer portion of said rim is higher than said inner portion of said rim.

30. A device as recited in claim 29, wherein said inner portion of said rim is recessed from said outer portion by an amount greater than a thickness of said flange of said reducer.

31. A device as recited in claim 30, wherein a bottommost part of said outer portion of said rim is higher than a topmost part of said flange of said reducer.

32. A device as recited in claim 24, wherein a bottommost part of said outer portion of said rim is higher than a topmost part of said flange of said reducer.

33. A device as recited in claim 24, wherein said cap includes an applicator coupled thereto.

34. A device as recited in claim 33, wherein said bottle contains a cosmetic product.

35. A device as recited in claim 33, wherein said bottle contains a nail care product.

36. A device as recited in claim 35, wherein said reducer includes an upper portion and a lower portion, wherein said upper portion is disposed closer to said flange than said lower portion, and wherein an inner cross-section of said upper portion is larger than an inner cross-section of said lower portion.

37. A device as recited in claim 24, wherein the flange of the reducer has an outer diameter smaller than an outer diameter of the inner portion.

38. A device as recited in claim 37, wherein a volume is defined between an outer surface of said lower portion of said reducer and an inner surface of said bottle such that product in said bottle is received in said volume when said bottle is moved to a non-upright position and spillage is reduced.

39. A device as recited in claim 38, wherein said lower portion of said reducer is disposed inside of said neck of said container.

40. A device as recited in claim 24, wherein said reducer includes an upper portion and a lower portion, wherein said upper portion is disposed closer to said flange than said lower portion, and wherein an inner cross-section of said upper portion is larger than an inner cross-section of said lower portion.

41. A device as recited in claim 24, wherein said bottle contains a nail care product.

42. A device as recited in claim 41, wherein said bottle is formed of glass.

43. A device as recited in claim 42, wherein said plurality of ribs protrude from a location below said flange, said plurality of ribs contact an inner surface of said bottle, and further wherein said reducer is tapered below said at least one rib.

44. A device as recited in claim 24, wherein an applicator is associated with said cap, said applicator including an application surface that retains the fluid product for application, and wherein when said cap is in the mounted position, said applicator extends through said reducer and said application surface is at least partially positioned below said reducer, wherein said reducer reduces the amount of product on the application surface, as the cap is moved from the mounted position and the application surface is withdrawn through said reducer.

45. A device as recited in claim 44, wherein a bottom of said reducer is above a bottom of said neck such that said reducer is entirely disposed in said neck.

46. A device as recited in claim 45, wherein said reducer is tapered and has a diameter which decreases toward a bottom of the reducer, and wherein an outer periphery of said flange is radially spaced from an inner periphery of the outer portion of said rim.

* * * * *